US006220544B1

(12) United States Patent
Dommer et al.

(10) Patent No.: US 6,220,544 B1
(45) Date of Patent: Apr. 24, 2001

(54) GUIDED MISSILE

(75) Inventors: Josef Dommer, Nurnberg; Werner Schroppel, Wendelstein; Martin Staudenmeir, Neunkirchen, all of (DE)

(73) Assignee: Diehl Stiftung & Co., Nürnberg (DE)

( * ) Notice: Subject to any disclaimer, the term of this patent is extended or adjusted under 35 U.S.C. 154(b) by 0 days.

(21) Appl. No.: 09/333,610

(22) Filed: Jun. 15, 1999

(30) Foreign Application Priority Data

Jun. 19, 1998 (DE) ..... 198 27 278

(51) Int. Cl.[7] ..... F42B 10/14
(52) U.S. Cl. ..... 244/3.28; 244/49
(58) Field of Search ..... 244/3.21, 3.24–3.3, 244/49

(56) References Cited

U.S. PATENT DOCUMENTS

| | | | | |
|---|---|---|---|---|
| 3,598,345 | * | 8/1971 | Suter | 244/3.27 |
| 3,690,595 | * | 9/1972 | Rusbach | 244/3.27 |
| 4,334,657 | * | 6/1982 | Mattson | 244/3.28 |
| 4,641,802 | * | 2/1987 | Zalmon et al. | 244/3.28 |
| 4,728,058 | * | 3/1988 | Brieseck et al. | 244/3.28 |
| 4,869,441 | * | 9/1989 | Steuer | 244/3.28 |
| 5,111,553 | * | 5/1992 | Muggeridge et al. | 244/3.28 |
| 5,114,095 | * | 5/1992 | Schroppel et al. | 244/3.28 |
| 5,685,503 | * | 11/1997 | Trouillot et al. | 244/3.28 |

FOREIGN PATENT DOCUMENTS

| | | | | |
|---|---|---|---|---|
| 19 25 055 | | 9/1970 | (DE) . | |
| 3441534 A1 | | 5/1986 | (DE) . | |
| 251890 | * | 1/1988 | (EP) | 244/3.27 |

* cited by examiner

*Primary Examiner*—Harold J. Tudor
(74) *Attorney, Agent, or Firm*—Scully, Scott, Murphy & Presser

(57) ABSTRACT

A guided missile (12), in particular a projectile which can be fired through a propellent charge gas pressure, having rudder blades (18) which cross each other and which can be pivoted open to steer the missile (12). Each rudder blade (18) is mounted in a guide slot (22) which is closed at the front end by an end portion (26). Each end portion (26) has a spoiler end face (28). Each end portion (26) projects radially beyond the lateral longitudinal ribs (24). At its distal end portion (32) the associated rudder blade (18) is provided with laterally mutually opposite, narrow guide ribs (36) which project out of the rudder blade profile (34).

5 Claims, 4 Drawing Sheets

GUIDED MISSILE

BACKGROUND OF THE INVENTION

1. Field of the Invention

The invention concerns a guided missile in particular a projectile which can be fired through the intermediary of a propellent charge gas pressure.

2. Discussion of the Prior Art

A guided missile of that kind or a mounting arrangement for the rudder blade of such a missile, in particular a projectile which can be fired by means of propellent charge pressure and which can be maneuvered by way of an over-calibre crossed-rudder system is known for example from DE 34 41 534 A1. When such a projectile is fired the rudder blades are folded in, that is to say they are mounted in associated guide and mounting slots in the projectile. Due to the usual, slightly irregular combustion of the propellent charge powder differential pressures occur in the propellent charge chamber, which can bend or twist the rudder blades. In order to prevent the rudder blades from being bent or twisted in that way the rudder blades are mounted or guided in guide slots. In the known projectiles the guide slots are open at the front end in order to make it easier for the rudder blades to be pivoted into the open condition after the respective projectile has been launched. Due to the guide slots being open at their front end in the known projectiles of the kind set forth in the opening part of this specification however it is only possible to a limited extent to avoid bending or twisting of the rudder blades due to the differential pressures in the propellent charge chamber.

SUMMARY OF THE INVENTION

Therefore the object of the present invention is to provide a guided missile of the kind set forth in the opening part of this specification in which such deformations of the rudder blades by bending or twisting as a result of the pressure differences obtaining in the propellent charge chamber are avoided to a further improved extent.

The fact that, in the guided missile according to the invention, each guide slot is closed at its front end by an end portion which is formed with a spoiler end face affords the advantage that, when the projectile is launched, a direct and immediate afflux flow in relation to the rudder blades at their distal end face, that is to say their end face which is remote from their pivot axis, is prevented, which affords the result that flexural and twisting deformation phenomena of the rudder blades can be prevented to a further improved degree. The respective spoiler end face advantageously produces an air flow in such a way that a force component radially inwardly in relation to the longitudinal axis of the projectile, which would prevent or slow down deployment of the rudder blades is avoided.

It is quite particularly desirable if, in the guided missile according to the invention, the end portion protrudes in a radial direction of the projectile beyond the longitudinal ribs and the associated rudder blade is provided at its distal end portion with narrow guide ribs which project out of the rudder blade profile and which are disposed in laterally mutually opposite relationship. Such a design configuration for which independent patent protection is requested optimally prevents undesired deformation of the rudder blades due to bending or twisting as a result of the inevitable differential pressures in the propellent charge chamber because. in the inwardly folded condition of the rudder blades, said guide ribs are in contact in the guide slot which is of increased height at its front end, thereby providing for suitable support for the respective rudder blade.

In the case of longer rudder blades, each rudder blade can be formed in a central portion with additional narrow guide ribs which are disposed in laterally mutually opposite relationship.

In order further to improve the pivotal opening movement of the rudder blades after the projectile according to the invention has been launched, it is desirable if a spring element is provided between the root portion of the respective rudder blade and the associated rudder blade holder for deployment of the rudder blade. The respective spring element can be formed by a spiral spring which with its spiral turns extends around the pivot axis about which the rudder blade can be pivoted open in relation to the associated rudder blade holder.

A protected and aerodynamically favourable arrangement of the respective spring element is afforded if the root portion of the rudder blade, for receiving the spiral turns of the spiral spring, is formed with a partially open gap or slot space which extends in an annular configuration around the pivot axis.

The guided missile according to the invention provides for a comparatively desirable flow therearound. That desirable flow around the missile advantageously results in unimpeded and consequently faster and more uniform, that is to say symmetrical, opening pivotal movement of the rudder blades. In addition, upon launch the mechanical loading on and thus the deformation of the rudder blades are relatively slight, thereby advantageously resulting in the positioning and control accuracy of the rudder blades being maintained.

The configuration of the longitudinal ribs which laterally delimit the respective guide slot, with an end portion which is closed at the front end and which projects beyond the longitudinal ribs in the radial direction of the projectile, and the configuration of the respective rudder blade with laterally mutually oppositely disposed guide ribs at the distal end portion of the respective rudder blade, that is to say the improved guidance effect for the respective rudder blade at its distal end portion, afford the further considerable advantage that the torques which take effect on the root portion of the respective rudder blade upon launch of the missile are considerably reduced. That has a correspondingly positive effect on the positional and control accuracy for the rudder blades. as has already been mentioned above.

BRIEF DESCRIPTION OF THE DRAWINGS

Further details, features and advantages will be apparent from the following description of an embodiment illustrated by way of example in the drawing of the guided missile according to the invention which is in particular a projectile which can be fired by means of propellent charge gas pressure. In the drawing.

DETAILED DESCRIPTION OF PREFERRED EMBODIMENTS

Figure 1:
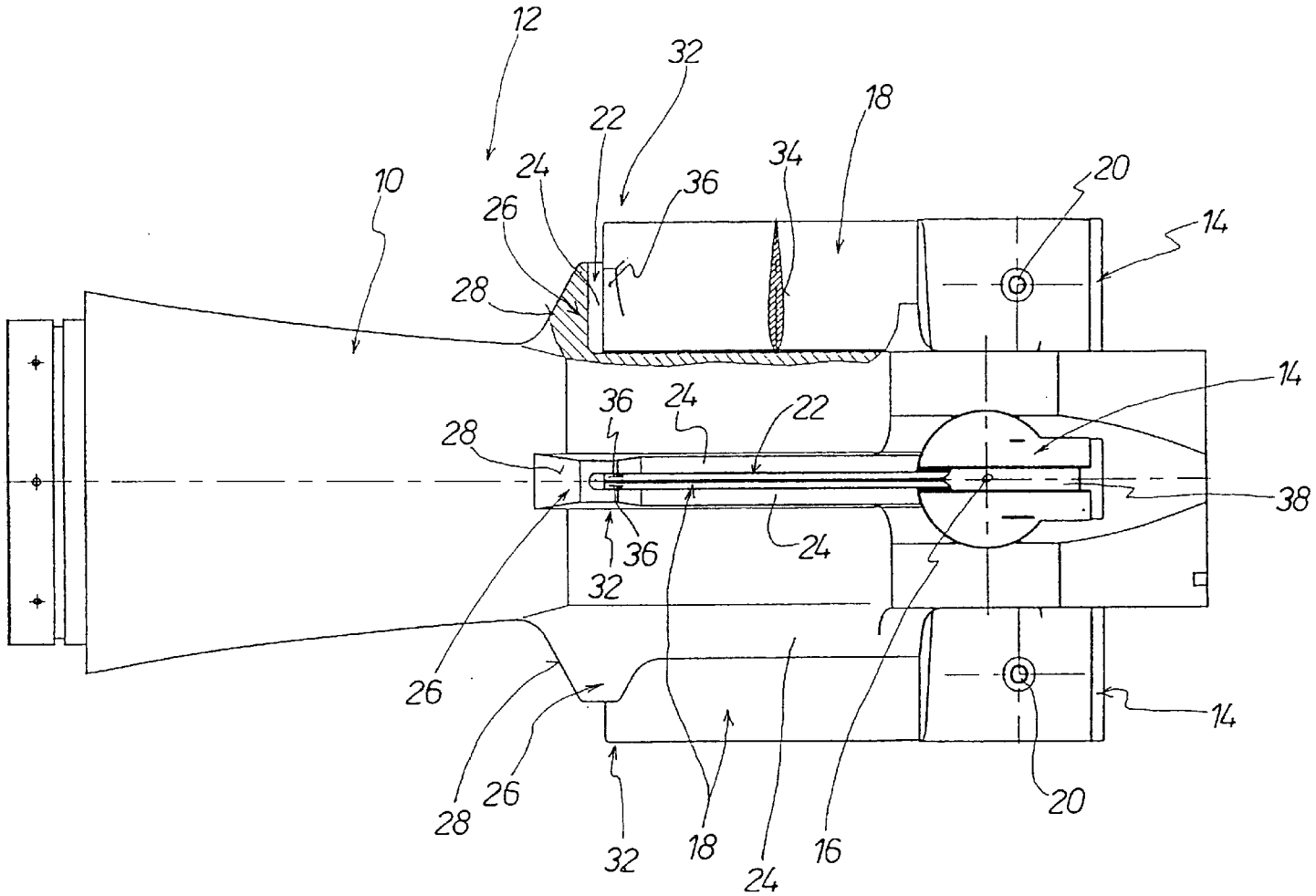
FIG. 1 is a partly sectional side view of a tail structure of the projectile, the rudder blades being in the inwardly folded position.
Figure 2:
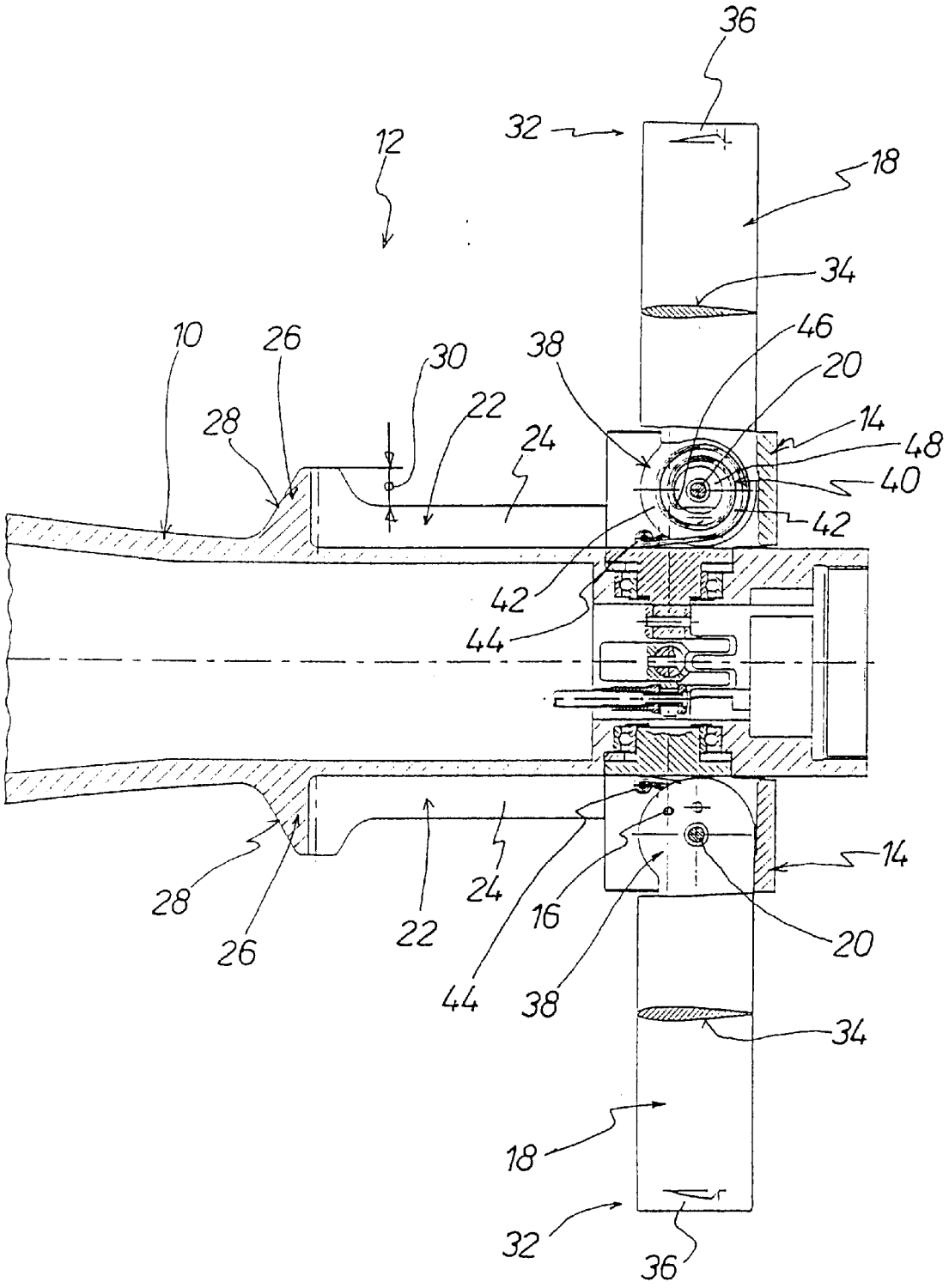
FIG. 2 is a view in longitudinal section of a part of the tail structure shown in FIG. 1, with the rudder blades being shown in the steering position of being pivoted open.

Referring to FIG. 1, shown in partial section therein as a side view is a tail structure 10 of a guided missile 12 which is in particular a projectile which can be fired by means of propellent charge gas pressure. As can also be seen from FIG. 2, provided on the tail structure 10 are rudder blade holders 14 which are disposed in diametrally mutually opposite relationship in pairs and which are each displaceable about a steering axis 16. Provided on each rudder blade holder 14 is an associated rudder blade 18 which is pivotable about a pivot axis 20 between the inwardly folded position shown in FIG. 1 and the pivoted-open steering position shown in FIG. 2.

To mount the rudder blades 18 the tail structure 10 of the missile 12 is formed with guide slots 22. Each guide slot 22 is defined by two lateral longitudinal ribs 24 and is closed at the front end by an end portion 26. Each end portion 26 is formed with a spoiler end face 28. Each end portion 26 projects in the radial direction beyond the lateral longitudinal ribs 24. That projection distance is indicated in FIG. 2 by reference numeral 30.

Figure 3:
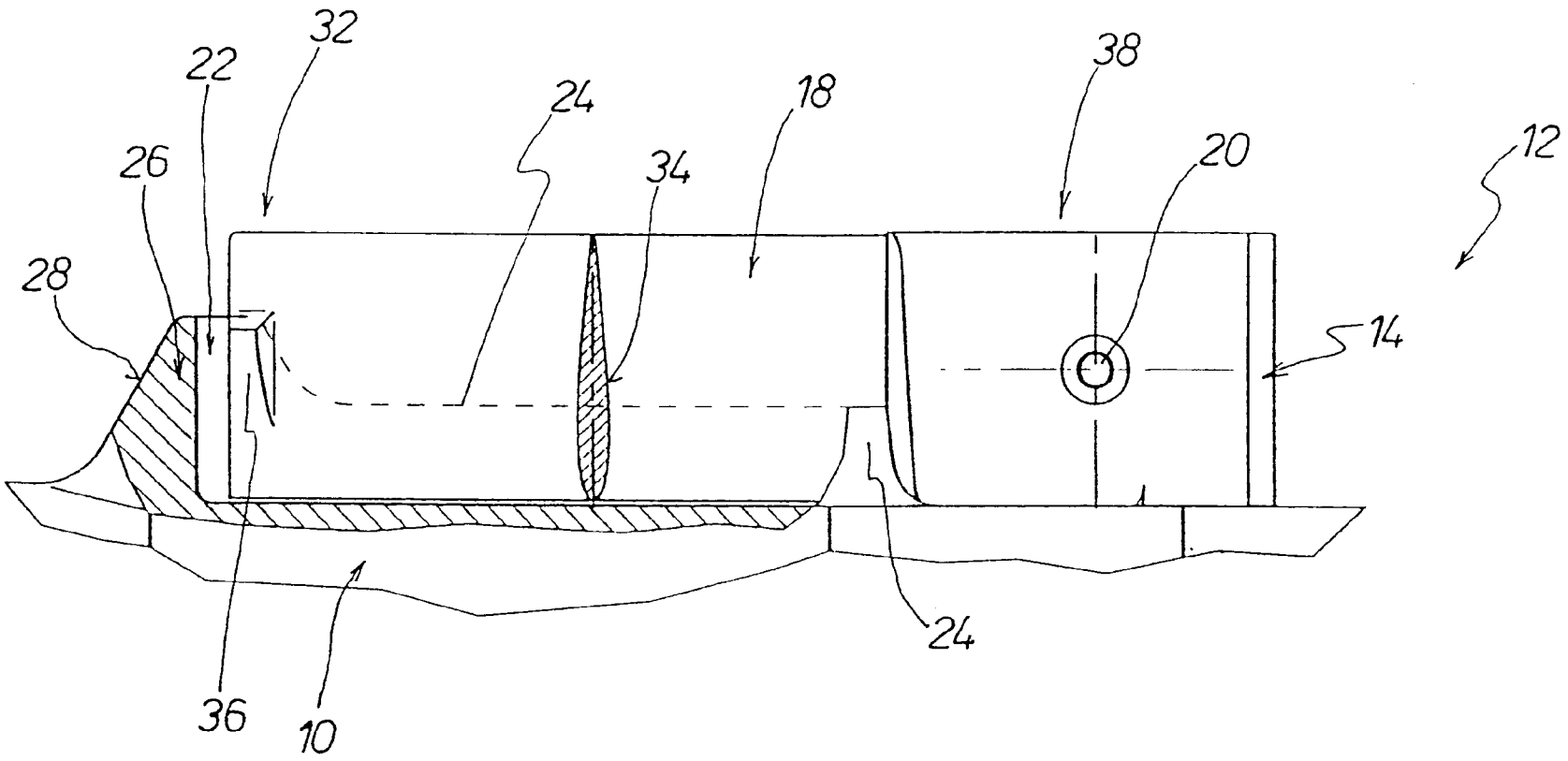
FIG. 3 is a partly sectional view on a larger scale of a portion of the tail structure shown in FIGS. 1 and 2 in combination with a rudder blade in the inwardly folded position.
Figure 4:
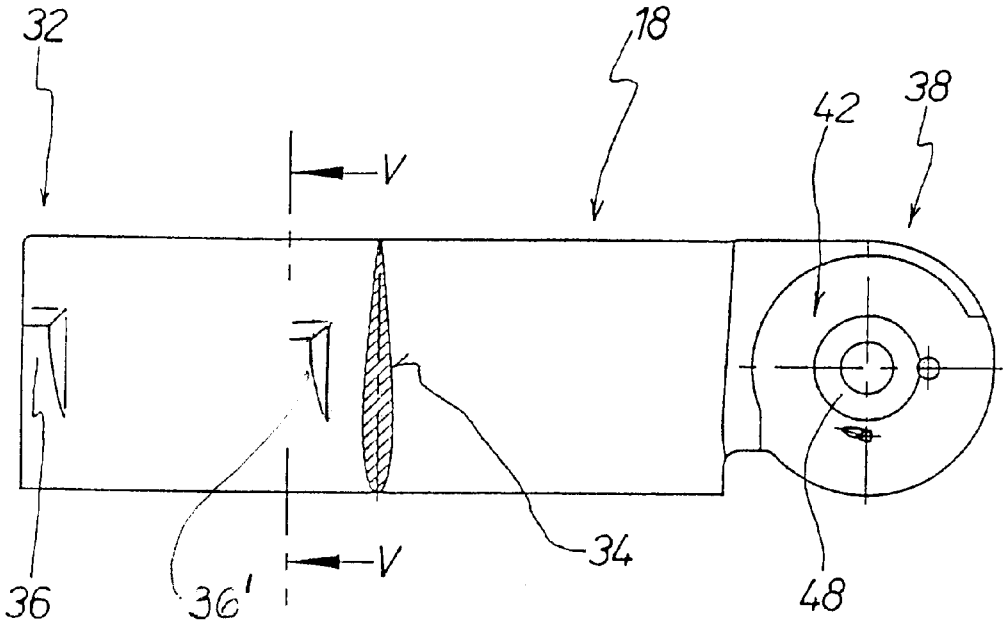
FIG. 4 is a side view of a rudder blade of the projectile.
Figure 5:
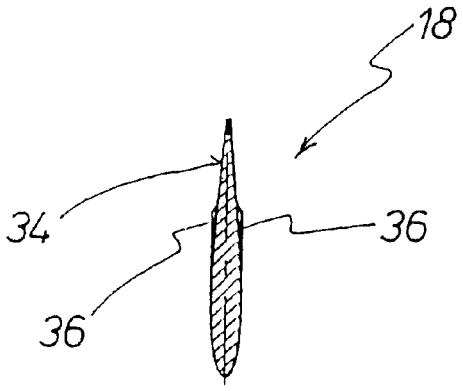
FIG. 5 is a view in section taken along line V–V in FIG. 4 through the rudder blade to illustrate the laterally mutually oppositely disposed guide ribs at the distal end portion of the rudder blade.

As can also be seen from FIGS. 3, 4 and 5, each rudder blade 18 is formed at its distal end portion 32 that is remote from the associated pivot axis 20. with narrow guide ribs 36 which protrude out of the rudder blade profile 34 and which are disposed in laterally mutually opposite relationship, as can be seen from FIG. 5.

If the rudder blades 18 are of a given length, then each rudder blade 18 for example can also be formed in a central portion between its distal end portion 32 and its proximal root portion 38 with additional narrow guide ribs 26' as shown in FIG. 4, which are disposed in laterally mutually opposite relationship.

In order to facilitate or promote the pivoting opening movement of the rudder blades 18 from the position shown in FIG. 1 into the position shown in FIG. 2, a spring element 40 (see FIG. 2) is provided between the root portion 38 of the respective rudder blade 18 and the associated rudder blade holder 14. The respective spring element 40 can be formed by a spiral spring which extends with its spiral turns around the pivot axis 20. As can also be seen from FIG. 4, the root portion 38 of the respective rudder blade 18, for receiving the spiral turns of the spiral spring 40, can be formed with an annular depression. that is to say with a gap as indicated at 42, which extends in an annular configuration around the associated pivot axis 20 and which is partially open in order to be able to secure the one end portion 48 of the spring element 40 to the associated rudder blade holder 14. The second end portion 46 of the spring element 40, which is remote from the first end portion 44, is fixed to the rudder blade 18, that is to say to an annular fixing portion 48 of the root portion 38 of the rudder blade 18 (see FIG. 2).

| List of references |
|---|
| 10 tail structure (of 12) |
| 12 missile |
| 14 rudder blade holder |
| 16 steering axis (of 18) |
| 18 rudder blade |
| 20 pivot axis (for 18) |
| 22 guide slot (in 10) |
| 24 longitudinal ribs (on 10) |
| 26 end portion (of 24, 26) |
| 28 spoiler end face (of 26) |
| 30 projection distance (of 26) |
| 32 distal end portion (of 18) |
| 34 rudder blade profile |
| 36 guide ribs (on 32) |
| 38 root portion (of 18) |
| 40 spring element (for 18) |
| 42 gap (at 38) |
| 44 end portion (of 40) |
| 46 second end portion (of 40) |
| 48 annular fixing portion (at 38) |

What is claimed is:

1. A guided missile (12) which is fired by a propellent charge gas pressure, comprising mutually crossing pivotally openable rudder blades (18), wherein each rudder blade (18) is mounted in a guide slot (22) laterally defined by lateral longitudinal ribs (24) and is pivoted out of said slot, each said guide slot (22) being closed at its front end by an end portion (26) which is formed with a spoiler end face (28), said end portion (26) projecting in a radial direction of the projectile (12) beyond the lateral longitudinal ribs (24) and wherein the therewith associated rudder blade (18) is provided at its distal end portion (32) with narrow guide ribs (36) which project out of the rudder blade profile (34) and which are in laterally mutually opposite relationship.

2. A guided missile according to claim 1 characterised in that each rudder blade (18) is provided in a central portion with additional narrow guide ribs 36' which are in laterally mutually opposite relationship.

3. A guided missile according to claims 1 or 3 characterised in that the respective rudder blade (18) is mounted with its proximal root portion (38) to an associated rudder blade holder (14) pivotally openable about a pivot axis (20), wherein a spring element (40) is provided between the root portion (38) of the respective rudder blade (18) and the associated rudder blade holder (14) for rudder blade deployment.

4. A guided missile according to claim 3 characterised in that the spring element (40) is formed by a spiral spring which extends with its spiral turns around the pivot axis (20).

5. A guided missile according to claim 4 characterised in that the root portion (38) of the rudder blade (18), for receiving the spiral turns of the spiral spring (40), is provided with a partially open gap (48) which extends in an annular configuration around the pivot axis (20).

* * * * *